US006533828B1

(12) United States Patent
Calzada

(10) Patent No.: US 6,533,828 B1
(45) Date of Patent: Mar. 18, 2003

(54) TRANSPARENT CLEAR CANDLE SHELL

(75) Inventor: Jose Francisco Calzada, Mixco (GT)

(73) Assignee: Xanadu Candle International Limited, Tortola (VG)

( * ) Notice: Subject to any disclaimer, the term of this patent is extended or adjusted under 35 U.S.C. 154(b) by 0 days.

(21) Appl. No.: 09/728,094

(22) Filed: Dec. 1, 2000

Related U.S. Application Data

(60) Provisional application No. 60/168,536, filed on Dec. 2, 1999.

(51) Int. Cl.[7] ..... C11C 5/00

(52) U.S. Cl. ..... 44/275; 431/288

(58) Field of Search ..... 44/275; 431/288

(56) References Cited

U.S. PATENT DOCUMENTS 3,586,473 A * 6/1971 Galloway ..... 44/275
5,882,363 A * 3/1999 Spaulding ..... 44/275

FOREIGN PATENT DOCUMENTS

CA 943340 * 3/1997

* cited by examiner

*Primary Examiner*—Cephia D. Toomer
(74) *Attorney, Agent, or Firm*—Robert M. Schwartz

(57) ABSTRACT

A transparent candle shell, which can be scented or decorated, is made of a formula based on polyamide resin and surrounds a candle core, which can be contiguous or spaced such that the shell constitutes a container. The inside candle can be wax, paraffin, gelled oil or polyamide-based and can be scented or unscented. The candle can be a pillar (stand alone).

28 Claims, 3 Drawing Sheets

TRANSPARENT CLEAR CANDLE SHELL

CROSS-REFERENCE TO RELATED APPLICATIONS

This application claims the benefit of U.S. Provisional Patent Application No. 60/168,536 filed Dec. 2, 1999.

BACKGROUND OF THE INVENTION

1. Field of the Invention

This invention relates to a candle having a wick surrounded by a combustible core in turn surrounded by a transparent shell.

2. Description of the Prior Art

A conventional candle, which can include a fragrance, is made of petroleum paraffin or waxy materials such as beeswax and tallow. More recently, hydrocarbon gels, gelling agents with oil, and polyamides have been used as candle base materials.

The use of polyamide in clear candles started in the 1970s as disclosed in U.S. Pat. Nos. 3,615,289 (1971) and 3,819,342 (1974) and German specification 2,357,567 (1974). More recently, a low molecular weight, ester-terminated polyamide, was blended with a liquid hydrocarbon to form a transparent composition having gel consistency and stated to be useful as a candle base material, as disclosed in U.S. Pat. No. 5,783,657 and PCT International application WO 98/17243 (both 1998). However, candle made of this composition show a sticky surface and low resistance to shear stresses.

The use of polyamide resins in combination with one or more 12-hydroxystearic acid ester solvents in a clear solid candle is disclosed in U.S. Pat. No. 5,882,363, (1999). In this case, the mechanical properties are better, but the burning presents a poor performance, with the formation of black pools and drowning of the wick.

SUMMARY OF THE INVENTION

It is accordingly an object of the invention to provide a candle that overcomes the disadvantages and drawbacks of the prior art as outlined above while affording a favorable combination of esthetic, mechanical, and burning characteristics.

In accordance with this invention, there is provided a candle comprising at least one wick surrounded by a core having a top surmounted by said at least one wick, a bottom, and sides, and comprising a combustible candle core composition which is surrounded by a non-sticky, shear resistant, and clear transparent shell comprising a combustible candle shell composition comprising at least 81% by weight of at least one dimer acid based polyamide resin and 0–19% by weight of at least one solvent for said polyamide resin.

A candle according to the invention can be presented as a self-supporting stand alone candle (a so-called "pillar" candle) or as a candle in a container, where the shell itself can constitute the container. The core within can be contiguous with the shell or removably placed within, with a gap of predetermined width between the shell and the core.

The candle according to this invention can be of any desired size and shape. In particular, a candle according to the invention can be higher than it is wide, or wider than it is high. The candle according to the invention can be uniform in cross-section or vary in cross-section along its height.

Thus, the core-shell construction of a candle according to the invention is particularly suitable for creating a great variety of esthetically pleasing and decorative shapes for the candle of the invention, including cylindrical, spherical, polygonal, tear-drop and free-form abstract shapes as well as human and animal shapes (such as a hand, a torso, or the head of a cat) and shapes of familiar inanimate objects (such as a telephone or a replica of a well-known building). The shell surrounds the core for at least 50% of its height and can extend up to the full height of the core and even higher, thus constituting a shade surrounding the flame when the candle burns.

The relative dimensions of the shell and the core in the candle according to the invention are defined such that the shell is at least 2 mm thick. The thickness of the shell need not be uniform throughout. The upper limit for the dimensions of the shell is defined such that the dimension of the shell as a fraction of the combined dimensions of the shell and the core measured outward from the wick can be up to 75% of the combined dimensions.

The term "combustible" is used in its conventional meaning to indicate that the material burns when ignited in the ordinary manner of a candle. The term is not used in its regulatory sense as promulgated by the US Department of Transportation to indicate a material having a flash point in a defined range. In fact, candles according to the invention desirably have a flash point higher than that of a regulatory "combustible" material.

The terms "clear" and "transparent" are used with their conventional meanings to indicate that object placed behind or within a candle (for example the wick or a decorative icon) can be discerned by a viewer. The term "visually compatible" is used to indicate that the combustible composition of the invention is clear and transparent as defined.

The term "dimer acid" is used to designate a known product obtained under dimerization conditions from unsaturated fatty acids having 15 to 21 carbon atoms, such as oleic acid, linoleic acid, and linolenic acid, and containing predominantly dicarboxylic acids having 30 to 42 carbon atoms, along with minor amounts of monocarboxylic acids and tricarboxylic acids, as well as hydrogenation products thereof.

The shell is made of a composition based on one or more dimer acid based polyamide resins that is transparent and that is compatible with the candle material making up the combustible candle core, and serves to contain the core material in the form of a candle. The shell can be scented or unscented, colored and/or decorated as desired or plain, with or without inclusions.

The dimer acid based polyamide resin can be a neutral or slightly acidic (i.e. not amine-terminated) polyamide having a molecular weight in the range from 1000 to about 60000 daltons, as obtained, for example, from the polymerization of a diamine with one or more dicarboxylic acids of which at least one is dimer acid as defined. Dicarboxylic acids which can be included in the polyamide according to the invention include oxalic acid, succinic acid, glutaric acid, adipic acid, 2-methylglutaric acid, azelaic acid, sebacic acid, isophthalic acid, and terephthalic acid. Diamines which can be included in the polyamide according to the invention include ethylenediamine, propylene-1,2-diamine, 1,6-diaminohexane, piperazine, N,N'-bis(2-aminoethyl) piperazine, and ether-interrupted alkylenediamines such as the polyoxyalkylenediamines disclosed, for example, in U.S. Pat. No. 6,077,900 here incorporated by reference.

Dimer acid based polyamide resins in which dimer acid is at least in part hydrogenated are particularly preferred.

The solvent when present is a non-resinous substance, which can be liquid or solid at ambient temperature, of high polarity, low polarity, or intermediate polarity, or a mixture of such substrates, that is miscible with the polyamide component of the combustible candle shell composition, such that up to 19 parts by weight of the solvent can be admixed with 81 or more parts by weight of polyamide and afford a clear composition at the intended use temperature (usually the normal ambient temperature) of the candle according to the invention. To remain part of the shell composition throughout its useful life the solvent should have a boiling point of at least 180° C.

High polarity solvents include saturated and unsaturated alcohols having 8–24 carbon atoms, ether alcohols having 6–36 carbon atoms, aliphatic carboxylic acids having 8–24 carbon atoms as well as amides and bis-amides of such carboxylic acids. Low polarity solvents include hydrocarbons having 10–50 carbon atoms. Intermediate polarity solvents include ethers and carboxylic acid esters having 10–60 carbon atoms.

The combustible candle core according to the invention can be made of a combustible composition the is the same as the shell composition, or of a different combustible composition such that any interactions that occur between the shell and the core do not adversely affect the favorable properties of the shell or the core, in particular the transparent appearance, mechanical sturdiness, and non-sticky feel of the shell. The core can be, but need not be, transparent. When the core composition and the shell composition are different, the core composition has a softening temperature no higher than that of the shell composition. Preferably the shell composition has a softening temperature at least 10° C. higher than that of the core composition.

The shell composition and the core composition can each be colored as desired. Striking visual effects can be obtained when the shell and the core compositions are of different colors.

The combustible candle core can, accordingly, be made of any conventional combustible candle composition, for example that of a typical beeswax or paraffin base candle. More particularly, the core composition comprises at least one ingredient selected from the group consisting of fatty acids having 14 to 24 carbon atoms, fatty acid esters of polyhydric alcohols, paraffins, polyamide resins, and waxes. The combustible candle core can also be made of the non-paraffin candle composition disclosed in commonly assigned U.S. Pat. No. 6,063,144 whose entire disclosure is here incorporated by reference.

BRIEF DESCRIPTION OF THE DRAWINGS

Each of FIGS. 1–6 represents in diagrammatic form a vertical cross-section of a candle having a clear transparent shell according to the invention. The plane of the cross-section includes the wick. In each of the figures, the wick is represented by line 1, the combustible candle core is represented by areas 2, and the clear shell is represented by areas 3.

DESCRIPTION OF PREFERRED EMBODIMENTS

Figure 1:
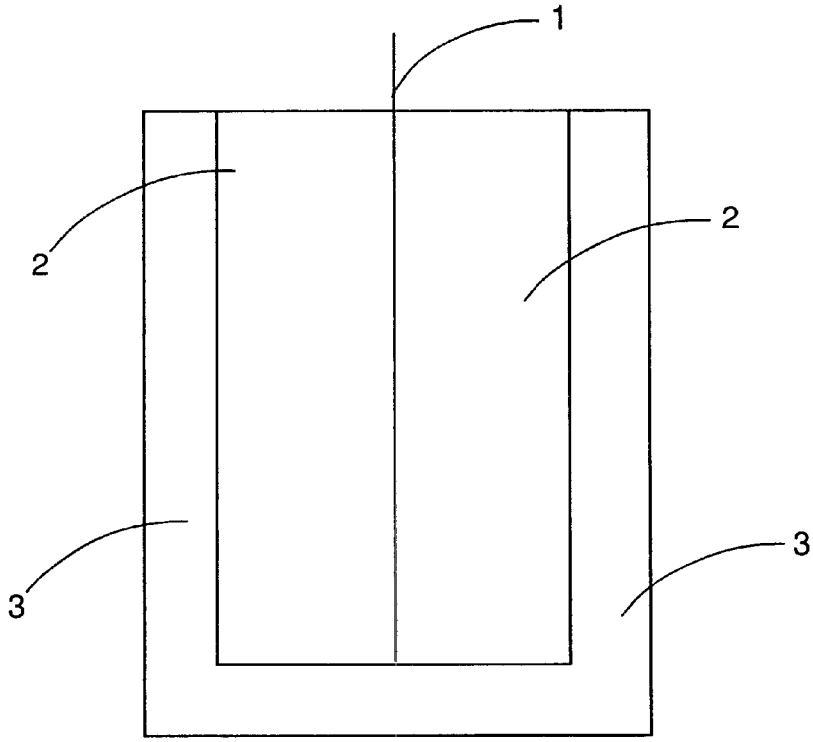
In FIG. 1, the shell 3 encompasses the bottom and the full height of the candle core 2.
Figure 2:
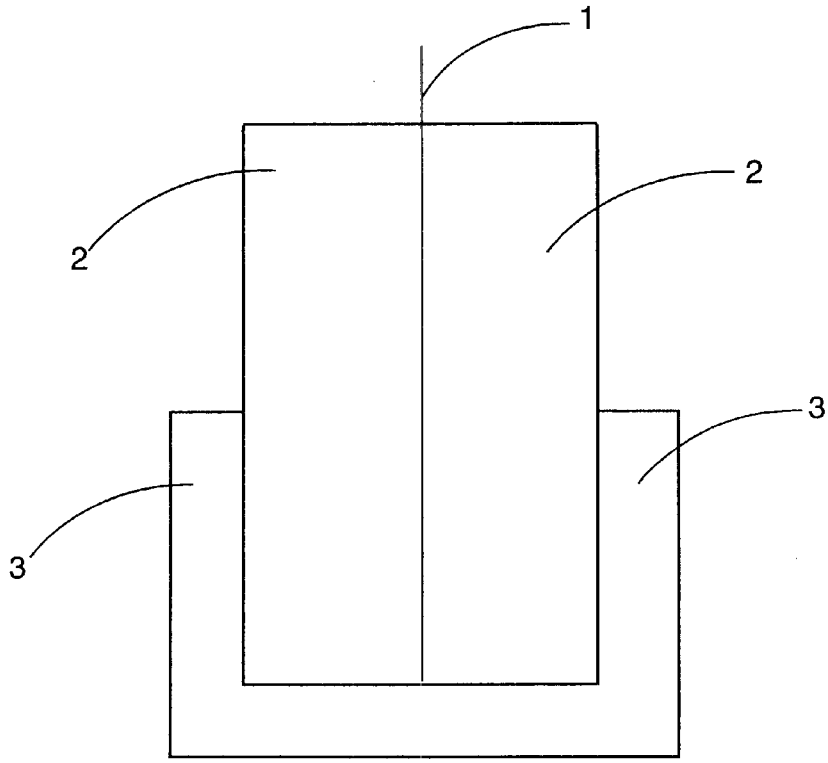
In FIG. 2, the shell 3 encompasses the bottom and a major portion of the height of the core 2.
Figure 3:
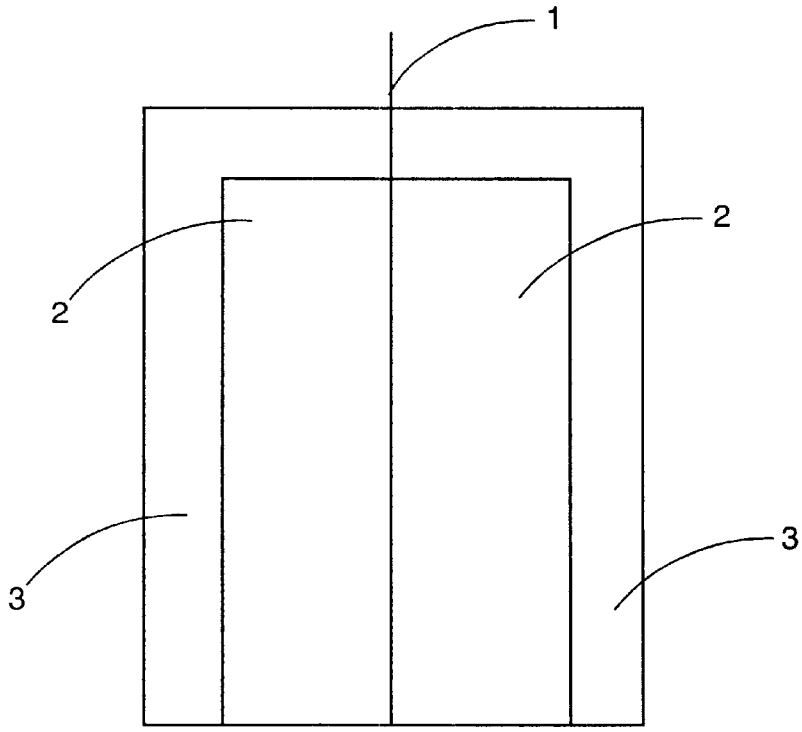
In FIG. 3, the shell 3 encompasses the full height of the core 2 and the top of the core 2.
Figure 4:
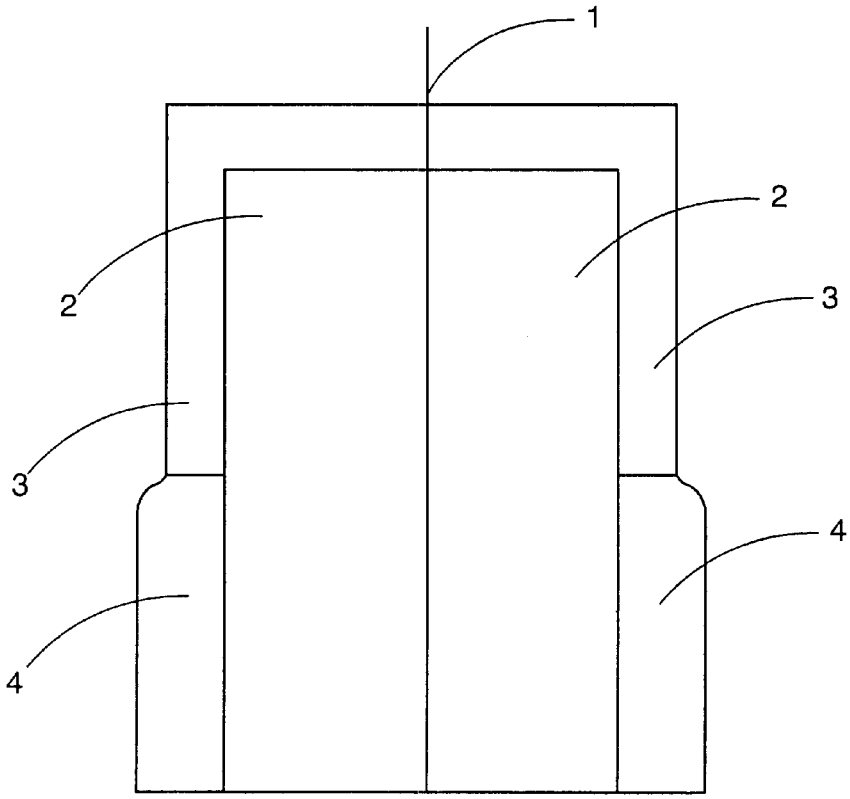
In FIG. 4, the shell 3 comprises discrete sections of varying thickness encompassing the full height of the core 2 and the top of the core 2, wherein the thicker sections of the shell are represented by areas 4.
Figure 5:
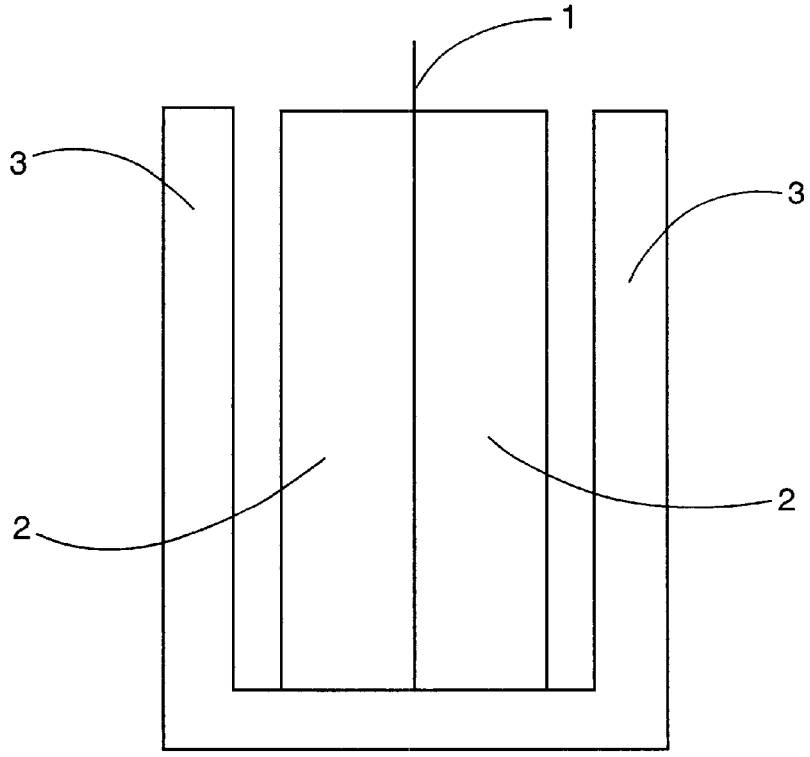
In FIG. 5, the shell 3 is spaced away from the core 2 and encompasses the bottom and the full height of the core 2.
Figure 6:
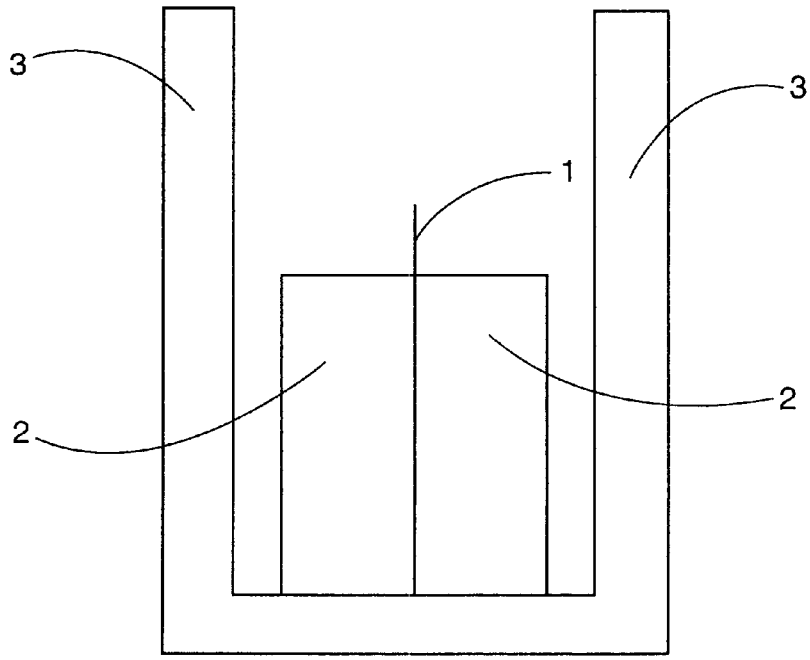
In FIG. 6, the shell is spaced away from the core 2 and extends beyond the full height of the core 2.

In a preferred embodiment, the cross-sections of the shell and the core are concentric circles with the wick at the center.

In a further preferred embodiment, the dimer acid based polyamide resin ingredient of the shell composition according to the invention has the formula $$\text{R-CO(NH-R'-NHCO-D-CO)}_n\text{-NR-R'-NH-CO-R,}$$

in which n is a number from 1 to 20;

R independently at each occurrence is a saturated or unsaturated aliphatic group having 7 to 25 carbon atoms or a cycloaliphatic group having 5 to 30 carbon atoms, and is terminated by a hydrogen atom (H) or a carboxyl group (COOH);

D independently at each occurrence is an aliphatic or cycloaliphatic residue of a dicarboxylic acid having 2 to 54 carbon atoms, provided that in at least one occurrence D is the hydrocarbon moiety of dimer acid; and R' independently at each occurrence is a hydrocarbylene group having 2 to 12 carbon atoms or a hydrocarbylene group interrupted by one or more ether groups.

Diamine—dimer acid based polyamide resins useful in the transparent shell candle of the invention are commercially available, for example, from Arizona Chemical Co., Wayne, N.J., under the trade name Uni-Rez® and from Cognis Co. Inc., Ambler, Pa., under the trade name Versamid®.

Polyamide resins based on hydrogenated dimer acid are commercially available from Cognis Co. Inc., under the trade name Versamid® 2000 series including a product by that name and a product Versamid® 2001 stated to be modified for greater flexibility.

Aliphatic R groups are saturated or unsaturated, for example, n-butyl, isobutyl, sec-butyl, n-hexyl, n-heptyl, 2-ethylhexyl, isooctyl, isodecyl, 3,5,5-trimethylhexyl, n-decyl, n-dodecyl, 2-butyloctyl, 10-undecenyl, oleyl, cetyl, stearyl, isostearyl, behenyl, and mixtures thereof.

Cycloaliphatic R groups are saturated or unsaturated, for example, cyclopentyl, cyclohexyl, 4-t-butylcyclohexyl, cholesteryl, cholestanyl, and R groups derived from other steroid and terpenoid alcohols.

D, the hydrocarbon moiety of dimer acid, is believed to be represented by a six carbon ring to which are attached two aliphatic groups each terminating in a methyl group and two aliphatic groups each terminating in a carboxyl group, and can contain 0–3 carbon-carbon double bonds.

R' is the hydrocarbylene or bivalent hydrocarbon moiety of an aliphatic or cycloaliphatic diamine and is, for example, ethylene (i.e. the hydrocarbon moiety of 1,2-diaminoethane), 1,2-propylene, 1,3-propylene, hexamethylene (hexane-1,6-diyl), dodecamethylene, 3,5,5-trimethylcyclohexane-1,3-diyl (the hydrocarbon moiety of isophoronediamine), and mixtures thereof.

Preferred high polarity solvent alcohols include lauryl alcohol, cetyl-stearyl alcohol, oleyl alcohol, and 2-hexyldecanol. Preferred high polarity solvent ether alcohols include triethylene glycol, methoxytripropylene glycol, (2-butoxy)ethoxyethanol, and polypropylene glycol monobutyl ether. Preferred high polarity carboxylic acids include oleic acid, neodecanoic acid, and dimer acid. Preferred high polarity carboxylic acid amides and bisamides include oleamide, N,N'-ethylenebisstearamide, and N,N'-ethylenebisoleamide.

Preferred low polarity solvent hydrocarbons include refined petroleum fractions including mineral oil and technical white oil, liquid paraffin, synthetic isoparaffinic hydrocarbons and tall oil unsaponifiables such as abietene.

Preferred intermediate polarity solvent ethers include triethylene glycol dimethyl ether, diamyl ether, and 1-methoxyhexadecane. Preferred intermediate polarity solvent esters include methyl oleate, tridecyl stearate, medium chain length (such as C8-C10) fatty acid triglyceride, and diisononyl adipate.

Emulsifiers when present are preferably nonionic and include, for example, glyceryl monooleate, glyceryl monostearate, propylene glycol monooleate, sorbitan monolaurate, and ethoxylated alcohols, amides, and alkylphenols with 4–14 ethylene oxide units.

Fragrance when present can be such as is perceptible when the candle is exposed to the atmosphere or such as is only perceived when released from the composition by heat as the candle burns. It is a feature of the invention that the low inherent odor level characterizing the selected ingredients of the composition facilitates the provision of candles with agreeable odor characteristics even without added scent while permitting the use of any desired fragrance without clashing with an inherent odor of the unscented composition. For the purpose of this invention, fragrance also includes material classified as flavor, which can be natural or synthetic or origin. Suitable natural and synthetic fragrance/flavor substances include those compiled by the US Food and Drug Administration in Title 21 of the Code of Federal Regulations, Sections 172.510 and 172.515 respectively. Particularly suitable fragrances include basil, bergamot, citrus, jasmine, lemongrass, rosemary, and vanilla. When present, the proportion of fragrance in the composition is determined by the strength of the particular fragrance to be used, and is generally in the range from 0.1 to 10% by weight, preferably from 0.5 to 5% by weight.

Oxidation inhibitor and/or ultraviolet absorber when present can be odorless or possess an agreeable odor. Suitable oxidation inhibitors include Vitamin C ascorbic acid and Vitamin E tocopherol as natural prototypes of the category, as well as the vitamin-inactive isomer erythorbic acid, oxy-acids of phosphorus such as phosphoric acid and polyphosphoric acid, aliphatic hydroxypolycarboxylic acids such as citric acid, malic acid, and tartaric acid, EDTA and its sodium and calcium salts, and alkyl-substituted phenols such as BHT, BHA, thymol, carvacrol, 4,4'-butylidenebis(2-t-butyl-5-methylphenol), 1,1,3-tris(2-methyl-4-hydroxy-5-t-butylphenyl)butane and 3,5-di-t-butyl-4-hydroxylphenylpropionic acid and its esters with C1–C18 monohydric alcohols or 2–6 functional polyhydric alcohols. Suitable ultraviolet absorbers absorb radiation in the range of wavelengths from about 270 nm to about 400 nm and include salicylic acid esters, 2-hydroxy-4-alkoxybenzophenones, and substituted derivatives of 2(2'-hydroxy-5'-alkylphenyl)benzotriazole. When present, the proportion of oxidation inhibitor and/or ultraviolet absorber is generally in the range from 0.005% to 1% by weight, preferably from 0.01% to 0.5%.

A candle shell can be prepared from shell compositions using several combinations of polyamide resins, solvents and additives.

1) 81–90% thermoplastic polyamide resin based on dimerized acids and amines, 5–15% isostearyl alcohol, 1–10% isoparaffinic petroleum solvent (aliphatic hydrocarbon) and 1–3% emulsifier such as sorbitan monooleate. To this, up to 10% of fragrance, 0.1 to 1.0% preservative such as antioxidants and UV protectors can be added as extra.

2) A single thermoplastic polyamide resin based on dimerized acid and amines or a mixture of two or more such resins without solvent, and 1.5–3% emulsifier (sorbitan monooleate). To this, up to 10% of fragrance, 0.1 to 1.0% antioxidants and UV protectors and a small quantity of free azelaic acid can be added as extra.

The candle shell can be made by any of three basic procedures or their combinations:

1) Molding of the shell by charging a mold having the shape of the final shell with a quantity of the shell composition to provide the desired thickness of the shell.
2) Partially emptying a candle mold filled with the shell mixture, in order to leave the faster cooling layer.
3) Extrusion (least recommended, because of the final appearance)

When inclusions are required, they are placed in the shell during the pouring or cooling operations. Painting on the surface is usually done on either face of the shell (inner or outer), when the required hardening is reached.

Once the shell is required, it can be filled with the candle core mixture (wax, paraffin or polyamide-based, with the wick) or it can be used in the form of a shade to put a smaller, perviously made candle inside to constitute the core.

The candles with transparent clear shell according to the invention are characterized by the following advantages.

1) Good burning characteristics, since the combustible core mixture is a composition formulated for that purpose.
2) Good mechanical properties, provided by the candle shell.
3) Good sensory properties (i.e. non-sticky), given by the candle shell.
4) Good sensory properties (visual) because of the beauty of the transparent material and also because of the possibility of decorations in the shell, included within the shell or painted on its faces.

The following Examples illustrate the invention without limiting its scope as defined by the appended claims. All parts are by weight.

EXAMPLES 1–4

The ingredients of the candle shell compositions shown below were charged to a heated mixing vessel and warmed with stirring until a homogeneous melt was obtained. The melt was then discharged into pre-cooled metal candle molds which were rotated to produce a layer of material approximately 5 mm thick in contact with the mold, allowed to cool and solidify, and removed.

The ingredients of the candle shell compositions were as follows:

| Example | 1 | 2 | 3 | 4 |
|---|---|---|---|---|
| Thermoplastic dimer acid-diamine polyamide (note 1) | 81 | 81 | 100 | 95 |
| Dimer acid-diamine polyamide Based on hydrogenated Dimer acid (note 2) | none | 9 | none | none |
| Oleyl alcohol | 10 | 10 | none | none |
| Isoparaffinic petroleum solvent (aliphatic hydrocarbon) | 9 | none | none | none |
| Fragrance | 5 | 5 | none | 5 |
| Sorbitan monooleate (emulsifier) | 1.5 | 1 | 1 | 1 |
| Antioxidant and Ultraviolet absorber | 0.5 | 1 | 0.5 | 1 |

(note 1) Polyamide from dimer acid, ethylenediamine, and azelaic acid (VERSAMID ® 1655, Cognis Corp).
(note 2) polyamide based on hydrogenated dimer acid and ethylenediamine (VERSAMID ® 2001, Cognis Corp).

A wick was subsequently inserted into each of the clear shells obtained from the above shell compositions, followed by a melted core composition containing a gelled blend of mineral oil and isostearyl alcohol with dimer acid based polyamide. When this was allowed to cool, clear candles in which the wick could be discerned for its whole length were obtained.

What is claimed is:

1. A candle comprising at least one wick surrounded by a core having a top surmounted by said at least one wick, a bottom, and sides, and comprising a combustible candle core composition which is surrounded by a non-sticky, shear resistant, and clear transparent shell comprising a combustible candle shell composition comprising 81–95% by weight of at least one dimer acid based polyamide resin and 5–19% by weight of at least one solvent for said polyamide resin.

2. A candle according to claim 1, having a cylindrical, spherical, polygonal, tear-drop or free-form abstract shape.

3. A candle according to claim 1 having a human or animal shape.

4. A candle according to claim 1, having a shape of a familiar inanimate object.

5. A candle according to claim 1, wherein said shell and said core each have a cross section, and the cross-sections of the shell and the core are concentric circles with the wick at the center.

6. A candle according to claim 1 in which said shell extends for at least 50% of the height of said core.

7. A candle according to claim 6 in which said shell surrounds the top and at least a portion of the sides of said core.

8. A candle according to claim 6 in which said shell surrounds the bottom and at least a portion of the sides of said core.

9. A candle according to claim 6 in which said shell extends beyond the top of said core.

10. A candle according to claim 1 in which said shell and said core are contiguous.

11. A candle according to claim 1 in which said shell and said core are separated by a gap.

12. A candle according to claim, 1 wherein said shell has a thickness, in which said thickness is at least 2 millimeters.

13. A candle according to claim 1, in which the dimension of the shell as a fraction of the combined dimensions of the shell and the core measured outward from the wick is up to 75% of the combined dimensions.

14. A candle according to claim 1 in which said polyamide resin comprises a polymerization product of a diamine with one or more dicarboxylic acids of which at least one is dimer acid, having a molecular weight in the range from 1000 to about 60000 daltons.

15. A candle according to claim 14 in which said dimer acid is hydrogenated.

16. A candle according to claim 1 in which said shell composition has a softening temperature at least 10° C. higher than that of the core composition.

17. A candle according to claim 16, in which said core composition comprises at least one ingredient selected from the group consisting of fatty acids having 14 to 24 carbon atoms, fatty acid esters of polyhydric alcohols, paraffins, polyamide resins, and waxes.

18. A candle according to claim 1 in which said shell composition additionally includes 0–5 parts by weight of at least one emulsifier, 0 to 10 parts by weight of at least one fragrance and 0 to 1 part by weight of at least one preservative, provided that the sum of said parts by weight is greater than zero.

19. A candle according to claim 18 in which said fragrance is selected from the group consisting of natural flavors and fragrances.

20. A candle according to claim 18 in which said fragrance is selected from the group consisting of synthetic flavors and fragrances.

21. A candle according to claim 1, in which said shell composition consists essentially of at least 81 parts by weight of thermoplastic polyamide resin based on dimerized acids and amines, 5 to 15 parts by weight of isostearyl alcohol, 5 to 10 parts by weight isoparaffinic petroleum solvent, 1–3 parts by weight of sorbitan monooleate emulsifier, 0 to 10 parts by weight of fragrance, and 0.1 to 1.0 part by weight combined antioxidant and UV absorber.

22. A candle according to claim 1 comprising a preservative, in which said preservative is selected from the group consisting of ultraviolet absorbers and oxidation inhibitors.

23. A candle according to claim 1 which is free standing.

24. A candle according to claim 1 in a container.

25. A candle comprising at least one wick surrounded by a core having a top surmounted by said at least one wick, a bottom, and sides, and comprising a combustible candle core composition which is surrounded by a non-sticky, shear resistant, and clear transparent shell comprising a combustible candle shell composition comprising at least 81% by weight of at least one dimer acid based polyamide resin and 0–19% by weight of at least one solvent for said polyamide resin, in which said shell composition consists essentially of 81 parts by weight of thermoplastic polyamide resin based on dimerized acids and amines, 10 parts by weight of oleyl alcohol, 9 parts by weight isoparaffinic petroleum solvent; and 1.5 parts by weight of sorbitan monooleate emulsifier, 5 parts by weight of fragrance, and 0.5 part by weight combined antioxidant and UV absorber are added thereto.

26. A candle comprising at least one wick surrounded by a core having a top surmounted by said at least one wick, a bottom, and sides, and comprising a combustible candle core composition which is surrounded by a non-sticky, shear resistant, and clear transparent shell comprising a combustible candle shell composition comprising at least 81% by weight of at least one dimer acid based polyamide resin and 0–19% by weight of at least one solvent for said polyamide resin, in which said shell composition consists essentially of 81 parts by weight of thermoplastic polyamide resin based on dimerized acids and amines, 9 parts by weight of thermoplastic polyamide resin based on hydrogenated dimer acid and amines, and 10 parts by weight of oleyl alcohol; and 5 parts by weight of fragrance, 1 parts by weight of sorbitan monooleate emulsifier, and 1 part by weight combined antioxidant and UV absorber are added thereto.

27. A candle comprising at least one wick surrounded by a core having a top surmounted by said at least one wick, a bottom, and sides, and comprising a combustible candle core composition which is surrounded by a non-sticky, shear resistant, and clear transparent shell comprising a combustible candle shell composition comprising at least 81% by weight of at least one dimer acid based polyamide resin and 0–19% by weight of at least one solvent for said polyamide resin, in which said shell composition consists essentially of 100 parts by weight of thermoplastic polyamide resin based on dimerized acids and amines, 1 part by weight of sorbitan monooleate emulsifier, and 0.5 part by weight combined antioxidant and UV absorber.

28. A candle comprising at least one wick surrounded by a core having a top surmounted by said at least one wick, a bottom, and sides, and comprising a combustible candle core composition which is surrounded by a non-sticky, shear resistant, and clear transparent shell comprising a combustible candle shell composition comprising at least 81% by weight of at least one dimer acid based polyamide resin and 0–19% by weight of at least one solvent for said polyamide resin, in which said shell composition consists essentially of 95 parts by weight of thermoplastic polyamide resin based on dimerized acids and amines, 5 parts by weight of fragrance, 1 parts by weight of sorbitan monooleate emulsifier, and 1 part by weight combined antioxidant and UV absorber.

* * * * *